United States Patent [19]

Walto

[11] Patent Number: 4,569,485

[45] Date of Patent: Feb. 11, 1986

[54] MIST EMITTER

[75] Inventor: Joseph J. Walto, Chaska, Minn.

[73] Assignee: The Toro Company, Minneapolis, Minn.

[21] Appl. No.: 530,348

[22] Filed: Sep. 8, 1983

[51] Int. Cl.[4] ..... B05B 1/26

[52] U.S. Cl. ..... 239/456; 239/498; 239/507; 239/515

[58] Field of Search ..... 239/456, 498, 507, 510, 239/512–516; 248/74.3; 24/16 PB, 17 A, 30.5 P

[56] References Cited

U.S. PATENT DOCUMENTS

| | | | |
|---|---|---|---|
| 481,082 | 8/1892 | Umholtz | 239/515 X |
| 1,753,019 | 4/1930 | Page | 239/515 X |
| 1,933,428 | 10/1933 | Harry | 239/515 |
| 2,048,125 | 7/1936 | Irving et al. | 239/514 |
| 2,410,215 | 10/1946 | Houghton | 239/515 |
| 2,489,952 | 11/1949 | Boudreaux et al. | 239/515 |
| 3,054,585 | 9/1962 | Roberts et al. | 24/16 PB X |
| 4,391,410 | 7/1983 | Smith | 239/512 X |
| 4,401,273 | 8/1983 | Olson | 239/498 |

*Primary Examiner*—Andres Kashnikow

*Attorney, Agent, or Firm*—Banner, Birch, McKie & Beckett

[57] ABSTRACT

A variable precipitation rate mist emitter (10) is disclosed. The emitter includes an emitter head (14) having an inlet opening (19), an outlet opening (26), a deflector disc (28) spaced from the opening for redirecting the water flowing from the outlet opening, and a projection (42) extending from the deflector disc toward the outlet. The projection has a tapered exterior surface with its smallest dimension adjacent the outlet opening and its largest dimension adjacent the deflector disc. A mechanism (30, 54, 56) for adjusting the position of the projection relative to the outlet opening locates a preselected and variable portion of the projection in the outlet opening whereby the size of the opening and the precipitation rate of the emitter are adjustable.

15 Claims, 10 Drawing Figures

MIST EMITTER

TECHNICAL FIELD

The present invention relates broadly to systems for applying water to growing vegetation. More particularly, the invention relates to a mist emitter head used in various irrigation applications. The emitter head includes a mechanism for varying the precipitation rate at which the water is applied.

BACKGROUND OF THE INVENTION

In the irrigation of certain plants, such as grapevines and avocado trees, there are a number of alternative methods of irrigation, two of which are drip irrigation and mist irrigation. Drip irrigation applies a steady drip water at various locations in the area being irrigated. Drip irrigation often comprises a plurality of pipes traversing the area being irrigated, either on top of the ground or subterranean, with the pipes being punctured and having drip emitters to cause a slow steady outpouring of drips at each of the emitters. While drip irrigation is often useful, it has some disadvantages. For example, because the water is being directly deposited into the ground or on the ground, it does not spread very far from its original point of application.

Mist irrigation has often been used as an alternative to drip irrigation. In mist irrigation, mist emitters extend from elevated pipes, which can be four inches to a foot or more above ground, or sometimes very close to the ground. A mist emitter has a head that throws out water into the air as a fine mist. Some advantages of mist irrigation over drip irrigation are that a large relatively wet area can be attained from a single mist head, especially when the mist head is quite far off the ground, and that a visual indication of whether the emitter is working is provided. Since mist emitter heads sometimes become plugged up quite easily, such a clogged condition is readily observed because a dry spot is visible instead of a wet patch.

A typical prior art mist emitter comprises a long slender tube coupled to a water source and terminating in an emitter head. FIG. 2 illustrates a prior art mist emitter head 14*a*. Emitter head 14*a* includes an inlet end 16*a* with a threaded exterior surface which connects to inlet tubing extending from a water supply conduit. Water passes through the inlet end 16*a* and exits emitter head 14*a* through a smaller diameter outlet opening or pinhole 18*a*. A deflector disc 20*a* is spaced from the outlet opening 18*a* and held at a fixed distance therefrom by a connecting post 22*a*, which also functions as a splitter bar to divide the water flowing from the head. A plurality of teeth 24*a* extend downward from the periphery of deflector disc 20*a*. As water flows out of outlet opening 18*a* it impacts against the bottom surface of deflector disc 20*a* and forms a mist-type sheet of water spraying radially outward. Teeth 24*a* reform the sheet into a plurality of streams to direct the water radially outward a further distance. For a given water pressure, mist emitter head 14*a* operates at a single precipitation rate. To vary the precipitation rate of the mist emitter 14*a*, a different head with a different diameter outlet opening 18*a* is utilized.

The problem with mist emitters of this type is that different plants require different precipitation rates. The primary way of varying the precipitation rate is to change the diameter of the pinhole. To do this, a relatively large variety of different mist heads, having different diameter holes, must be stocked. Moreover, because the pinhole is quite tiny, it tends to clog up. Thus, a filtered water supply is required in most mist irrigation systems.

SUMMARY OF THE INVENTION

The present invention is directed to a variable precipitation rate mist emitter for use in irrigation systems. The mist emitter includes an emitter head having an inlet opening for coupling to a water source, an outlet opening for emitting a fine stream of water from the head, and a deflector disc spaced from the opening for redirecting the water flowing from the outlet opening. A mechanism is provided for adjusting the size of the outlet opening to adjust the precipitation rate of the mist of water flowing from the emitter.

In a preferred embodiment, the adjusting mechanism includes a tapered projection extending from the deflector disc into the outlet opening and a mechanism for adjustably positioning the depth to which the projection extends into the outlet opening. The projection has a tapered exterior surface with its smallest dimension adjacent to the outlet opening and its largest dimension adjacent the deflector disc.

The emitter head is preferably formed as an integral plastic body with the deflector disc joined to the outlet opening by a flexible connecting hinge. An adjustment post or bar extends from a portion of the connecting hinge, and a portion of the connecting hinge is formed with a hole through which the adjustment post extends. By adjusting the position of the hole relative to the adjustment post, the spacing of the deflecting disc from the outlet opening is adjusted. The depth which the projection extends into the outlet opening is thus also adjusted. The adjustment post is formed with a plurality of serrations which couple to the hole in the flexible hinge to set the deflecting disc at the desired spaced position above the outlet opening.

A mist emitter in accordance with the present invention has a significant advantage over prior art mist emitters because a user needs to stock only a single type of mist emitter head, which will operate at a variety of precipitation rates. Since the deflector disc is adjustable relative to the outlet opening, the projection or cone can be moved inwardly and outwardly relative to the outlet opening, thereby adjusting its effective diameter. The diameter of the outlet opening, which controls the precipitation of the emitter, thus can be quickly and easily adjusted simply by snapping the connecting hinge into one of the different serrations. On the other hand, with prior art mist emitters a user requires a plurality of emitter heads with different size outlet openings to permit the user to adjust the precipitation rate of the emitters, i.e., each emitter head operates at a single precipitation rate for a given water line pressure.

Various advantages and features of novelty which characterize the invention are pointed out with particularity in the claimed annexed hereto and forming a part thereof. However, for a better understanding of the invention, its advantages, and objects obtained by its use, reference should be had to the drawings which form a further part hereof, and to the accompanying descriptive matter, in which there is illustrated and described several embodiments of the invention.

DETAILED DESCRIPTION OF THE PREFERRED EMBODIMENTS

Figure 1:
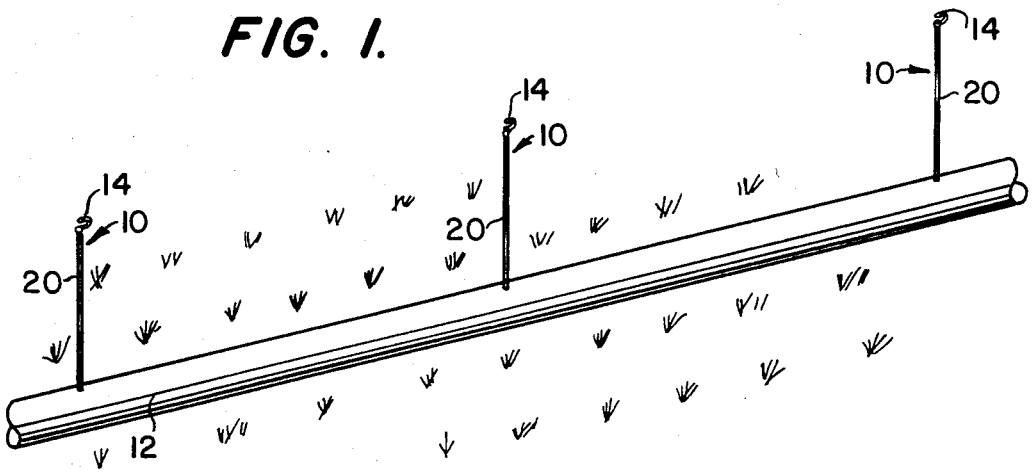
FIG. 1 is a perspective view illustrating a plurality of mist emitters connected a water supply line.
Figure 2:
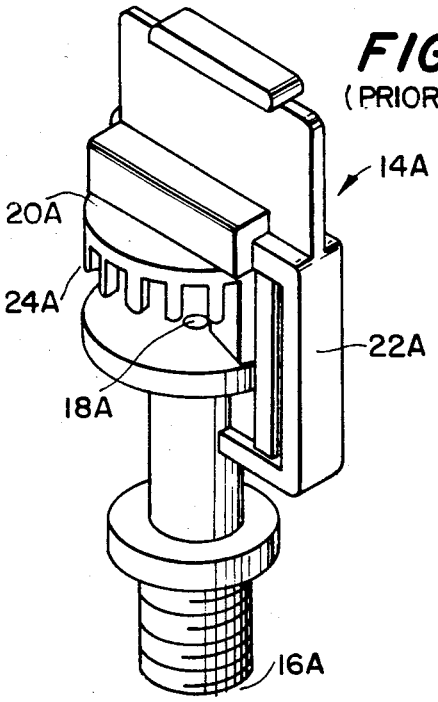
FIG. 2. (PRIOR ART)
FIG. 2 is a perspective view of a prior art type of mist emitter.

Referring to the drawings in detail, wherein like numerals indicate like elements, there is shown in FIG. 1 a plurality of mist emitters in accordance with the present invention, designated generally as 10. Mist emitters 10 are connected to a water supply conduit 12 which delivers water under pressure to the emitters 10 for purposes of watering or irrigating the area surrounding the emitters.

Figure 3:
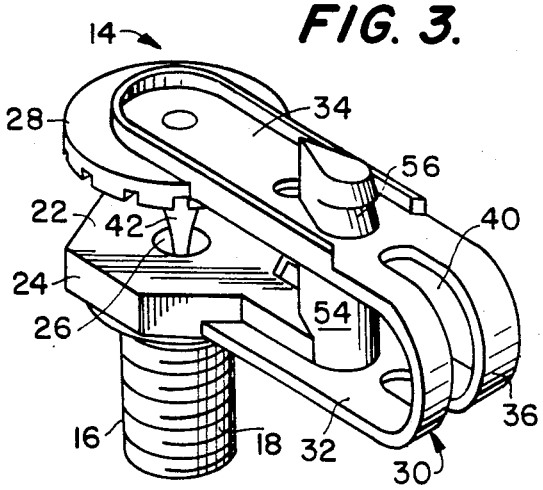
FIG. 3 is a perspective view of a mist emitter head in accordance with the present invention.

FIG. 3 illustrates a mist emitter head 14 which is used with a mist emitter 10 of the present invention. Emitter head 14 includes an inlet end 16 having a threaded exterior surface 18 and an inlet opening 19. A plurality of stream straightening ridges 21 extend from the interior surface of inlet end 16. Inlet end 16 is threadedly connected to a tube 20 of mist emitter 10, which places emitter head 14 in fluid communication with water supply conduit 12. A lower disc 22 has a hex-head perimeter surface 24 for facilitating the threading of emitter head 14 to tube 20. An outlet opening 26, in the form of a fine pinhole, is formed through lower disc 22. An upper deflector disc 28 is held in position above and spaced from outlet opening 26 by a flexible connecting strap or hinge 30. Connecting hinge 30 includes a first or lower section which extends laterally from one side of lower disc 22, an upper or second section 34 extending laterally from one side of deflector disc 28 and a connecting section 36 joining first and second sections 32 and 34. A slot 40 is formed along sections 32, 34 and 36 to reduce the weight of emitter head 14 and enhance the flexibility of hinge 30.

Figure 4:
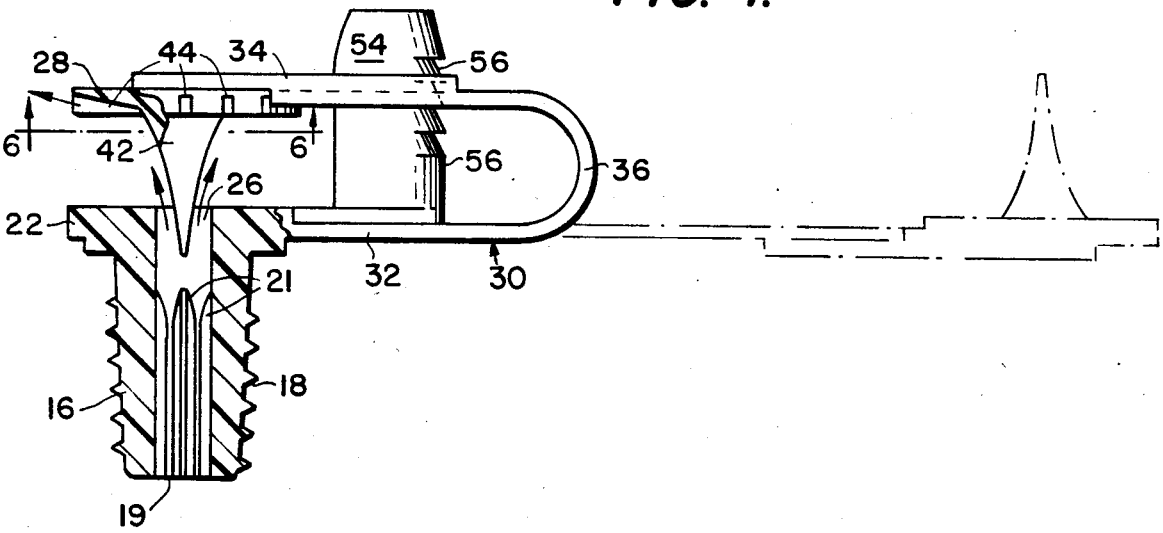
FIG. 4 is a side view of the mist emitter head of FIG. 3, partially in section.
Figure 5:
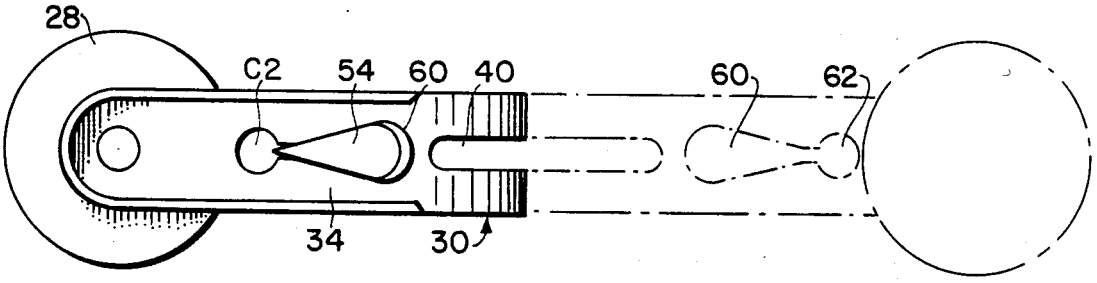
FIG. 5 is a top plan view of the mist emitter of FIG. 3.
Figure 6:
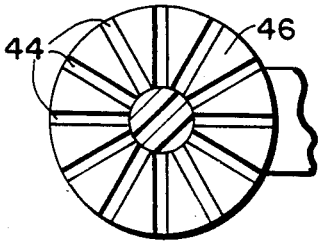
FIG. 6 is a plan view taken generally along line 6—6 of FIG. 4.

A projection 42, in the form of a tapered cone having a concave exterior surface, extends downward from deflector disc 28 when it is in its operative position, as shown in FIG. 3 and in full line in FIG. 4. As seen therein, a portion of projection 42 extends into inlet opening 26 to restrict the size of the opening. The depth or amount which projection 42 extends into opening 26 is adjustable. Since the outer surface of projection 42 tapers outwardly from a smallest diameter at its bottom end to its largest diameter adjacent disc 28, the amount which opening 26 is restricted by projection 42 is also adjustable by adjusting the depth to which projection 42 extends into opening 26. Such change of depth adjusts the precipitation rate of the mist emitter.

A plurality of grooves 44 are formed in a bottom deflecting surface of deflector disc 28. Grooves 44 extend radially outward and slightly upward from projection 42. Grooves 44 reform the water passing from outlet opening 26 into a plurality of separate streams for a somewhat longer throw than would exist if surface 46 were merely flat. However, the deflecting surface of disc 22 can be a flat disc in which case the water spray merely impacts and forms into a fine mist. Alternate bottom surfaces of disc 28 are shown in FIGS. 7 through 10. The alternate surfaces are used to attain different throw patterns for the water.

Figure 7:
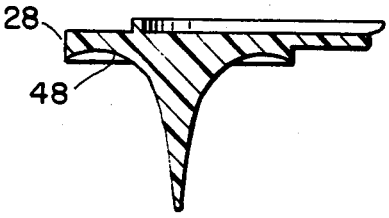
FIG. 7 is a sectional view of another embodiment of a deflector disc for use in a mist emitter in accordance with the present invention.
Figure 8:
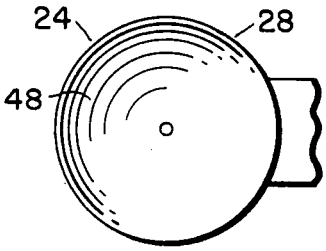
FIG. 8 is a bottom plan view of the deflector disc of FIG. 7.
Figure 9:
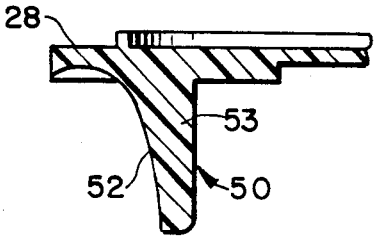
FIG. 9 is a sectional view of a further embodiment of a deflector disc for use in a mist emitter in accordance with the present invention.
Figure 10:
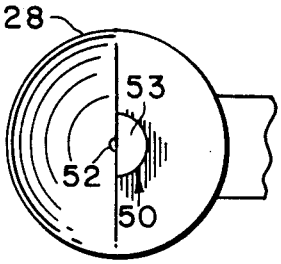
FIG. 10 is a bottom plan view of the deflector disc of FIG. 9.

In FIGS. 7 and 8, disc 28 has a bottom deflecting surface 48 which is concave without grooves and extends completely around projection 42. Water impacting against surface 48 forms into a sheet-like mist of water. In FIG. 9, an alternate projection 50 extends downward from deflector disc 28. Projection 50 has a tapered surface 52 extending about a portion of its perimeter with the remaining portion 53 of the projection being a straight cylinder with a diameter approximately the same as that of inlet opening 26. When projection 50 is inserted into inlet opening 26 the cylindrical section 53 of the projection blocks the exit of water from opening 26 around section 53 so that water exits only along surface 52 of projection 50. The arc through which water precipitates from the emitter head is thus limited. In the embodiment shown in FIGS. 9 and 10, surface 52 extends about 180°, while cylinder section 53 of projection 50 extends about the other 180°; however, different proportions of surface 52 and cylindrical section 53 of projection 50 can be used to vary the arc through which water precipitates.

To adjust the precipitation rate of emitter 10, a mechanism is provided for adjusting the distance deflector disc 28 is spaced from inlet opening 26, to thereby adjust the size of the restricted inlet opening 26. To accomplish this, a connecting post 54 extends upward from first section 32 of hinge 30. A plurality of serrations 56 are formed in at least a portion of the exterior surface of connecting post 54. In a preferred embodiment, serrations 56 extend about the surface of post 54 which faces away from opening 26, and the portion of the surface of post 54 which faces opening 26 if formed as a wedge shape to function as a splitter bar which divides the spray of water issuing from outlet opening 26. A coupling hole 60 is formed in second section 34 of hinge 30. Hole 60 has a configuration approximating the shape of the outer surface of connecting post 54. To set the position of projection 42 in outlet opening 26, hinge 30 is bent from the phantom line position shown in FIG. 4 to the full line position shown therein, the post 54 is slipped through hole 60. Thereafter, first section 34 is pushed down upon post 54 until a desired serration 56 is reached which locates projection 42 a proper depth within opening 26 to attain the desired precipitation rate. Hole 60 also includes an additional circular cutout 62 adjacent its narrow, tapered end to facilite the movement of the hole about post 54. If a new precipitation rate is desired, section 34 of hinge 30 is merely moved upward or downward along post 54 to adjust the depth of projection 42 in opening 26. Thus, the precipitation rate of mist emitter 10 is readily adjustable without the need of replacing the emitter or emitter head, as in common in prior art mist emitters.

Numerous characteristics and advantages of the invention have been set forth in the foregoing description, together with details of the structure and function of the invention, and the novel features thereof are pointed out in the appended claims. The disclosure, however, is illustrative only, and changes may be made in detail especially in matters of shape, size and arrangement of parts, within the principle of the invention, to the full extent indicated by the broad, general meaning of the terms in which the appended claims are expressed.

I claim:

1. A variable precipitation rate mist emitter for use in an irrigation system comprising:

an emitter head having an inlet opening for coupling to a water source;

an outlet opening for emitting water from the head;

a deflector disc spaced from said opening for redirecting the water flowing from said outlet opening;

a projection extending from said deflector disc toward said outlet, said projection having a tapered exterior surface tapering outwardly from its smallest dimension adjacent the outlet opening and means for adjusting the position of said projection relative to said outlet opening to locate a preselected and variable portion of said projection in said opening whereby the size of said opening and the precipitation rate of the emitter are adjustable;

said position adjusting means including a post extending upward from a lateral extension adjacent said outlet opening and said post being coupled between said outlet opening and said deflector disc;

said position adjusting means further including a plurality of stops on said post for adjustably holding said disc at a plurality of positions relative to said outlet opening, said stops including a plurality of serrations on the outer surface of said post; and a coupling flange extending laterally from said deflector disc and including a coupling hole through which said post passes.

2. A mist emitter in accordance with claim 1 wherein said post is mounted laterally to one side of said outlet opening and includes a flow splitting surface facing said outlet opening.

3. A mist emitter in accordance with claim 1 wherein said disc includes a deflecting surface facing said outlet opening against which water passing from said outlet opening impacts in order to be redirected.

4. A mist emitter in accordance with claim 3 wherein said deflecting surface includes a plurality of grooves extending radially outward.

5. A mist emitter in accordance with claim 3 wherein said deflecting surface is formed as a ring-shaped concave surface extending around substantially the entire projection.

6. A mist emitter in accordance with claim 3 wherein said deflecting surface includes a concave surface surrounding a portion of said projection and the remaining portion of said projection having a diameter corresponding to the diameter of said outlet opening to block the flow of water from said outlet opening along said remaining portion of said projection.

7. A mist emitter in accordance with claim 1 wherein said exterior surface of said projection is substantially conical.

8. A variable precipitation rate mist emitter for use in an irrigation system comprising an integrally formed plastic body having an inlet opening, an outlet opening, a deflector disc, an adjustment post and a connecting hinge, said inlet opening being adapted to be coupled to a water source and water directed to the emitter exiting through said outlet opening, said connecting hinge including a first section extending laterally from one side of said outlet opening, a second section extending laterally from one side of said deflector disc and a connecting section joining said first and second sections, said adjustment post extending upward from said first section of said connecting hinge and including a plurality of serrations on at least a portion of its outer surface, a coupling hole being formed through said section second of said connecting hinge and being received about said post and held in position by one of said serrations to position said deflector disc at an adjustable distance from said outlet opening, said deflector disc including a substantially conical projection, said conical projection being aligned with and extending into said outlet opening when said coupling hole is mounted on said post to restrict the size of said outlet opening, the amount said outlet opening is restricted by said projection being adjustable by adjusting the position of said connecting hole on said serrations whereby the precipitation rate of the emitter is adjustable.

9. A mist emitter in accordance with claim 8 wherein the conical projection has a concave exterior surface.

10. A mist emitter in accordance with claim 8 wherein said post includes a wedge-shaped exterior surface facing said outlet opening for splitting the flow of water therefrom.

11. A mist emitter in accordance with claim 8 wherein said disc includes a deflecting surface facing said outlet opening against which water passing from said outlet opening impacts in order to be redirected.

12. A mist emitter in accordance with claim 11 wherein said deflecting surface includes a plurality of grooves extending radially outward.

13. A mist emitter in accordance with claim 11 wherein said deflecting surface is formed as a ring-shaped concave surface extending around substantially the entire projection.

14. A mist emitter in accordance with claim 11 wherein said deflecting surface includes a concave surface surrounding a portion of said projection and the remaining portion of said projection having a diameter corresponding to the diameter of said outlet opening to block the flow of water from said outlet opening along said remaining portion of said projection.

15. A variable precipitation rate mist emitter for use in an irrigation system comprising:

an emitter head having an inlet opening for coupling to a water source;

an outlet opening for emitting a fine stream of water from said head;

a deflector disc spaced from said opening for redirecting the water flowing from said outlet opening;

means for adjusting the size of said outlet opening to adjust the precipitation rate of the mist of water flowing from said emitter, said adjusting means including a tapered projection extending from said deflector disc into said outlet opening and positioning means for adjustably positioning the depth which said tapered projection extends into said outlet opening, said positioning means including a flexible hinge connected between said inlet opening and said deflector disc and an adjustment post fixed to and extending from one section of said hinge, and means for adjustably securing another section of said hinge to a plurality of positions along said post.

* * * * *